US006344169B2

(12) United States Patent
Tsuchida et al.

(10) Patent No.: US 6,344,169 B2
(45) Date of Patent: Feb. 5, 2002

(54) METHOD FOR COMPACTION OF POWDERS FOR POWDER METALLURGY

(75) Inventors: Takehiro Tsuchida; Hiroshi Yaguchi, both of Kobe; Tetsuya Sawayama, Yakasago; Masaaki Sato, Takasago; Yoshikazu Seki, Takasago; Nobuaki Akagi, Takasago, all of (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/433,071

(22) Filed: Nov. 3, 1999

(30) Foreign Application Priority Data

Nov. 5, 1998 (JP) ..... 10-315030
Nov. 5, 1998 (JP) ..... 10-315031
Nov. 5, 1998 (JP) ..... 10-315032
Nov. 5, 1999 (JP) ..... 11-284827

(51) Int. Cl.[7] ..... B22F 3/12
(52) U.S. Cl. ..... 419/38; 419/54
(58) Field of Search ..... 419/38, 54

(56) References Cited

U.S. PATENT DOCUMENTS 3,901,742 A * 8/1975 Facaros ..... 148/105
4,006,016 A * 2/1977 Zambrow et al. ..... 75/221
4,047,983 A * 9/1977 Falkowski et al. ..... 148/105
4,955,798 A 9/1990 Musella et al. ..... 419/31
5,651,841 A * 7/1997 Moro et al. ..... 148/309
5,754,936 A * 5/1998 Jansson ..... 419/10
5,925,836 A * 7/1999 Krause et al. ..... 75/246
5,977,033 A * 11/1999 Lefebure et al. ..... 508/551
5,980,603 A * 11/1999 Thomas et al. ..... 75/252
6,126,894 A * 10/2000 Moxson ..... 419/2
6,190,605 B1 * 2/2001 Cadle et al. ..... 419/66

FOREIGN PATENT DOCUMENTS

| | | |
|---|---|---|
| JP | 41-006549 | 4/1966 |
| JP | 54-014781 | 6/1979 |
| JP | 54-041525 | 12/1979 |
| JP | 2-156002 | 6/1990 |
| JP | 3-025278 | 4/1991 |
| JP | 7-245209 | 9/1995 |
| JP | 8-100203 | 4/1996 |
| JP | 2710152 | 10/1997 |
| JP | 9-272901 | 10/1997 |

OTHER PUBLICATIONS

ASM Handbook vol. 7, Powder Metallurgy, 9th ed., pp. 306–307, 1984.*
Jones, W.D., "Fundamental Priciples of Powder Metallurgy," pp. 301–312, 1960.*
R. M. German, et al., "Comparative evaluation of lubricants for ferrous structural alloys", Metal Powder Report, vol. 42, No. 11, 1987, pp. 781–784 and 786.
F. Chagnon, et al., Development of High Density materials for P/M Applications, Adv. Powder Met. Pt. Mater., No. 3, 1994, pp. 199–206.

* cited by examiner

*Primary Examiner*—Daniel J. Jenkins
(74) *Attorney, Agent, or Firm*—Oblon, Spivak, McClelland, Maier & Neustadt, P.C.

(57) ABSTRACT

A method for compacting powders for powder metallurgy comprises packing powders for powder metallurgy formulated with a lubricant in a compacting die applied with a lubricant on inner wall surfaces thereof, and subjecting the powders to warm or hot compaction. The powders contain the lubricant in an amount up to 0.2 wt %, non-inclusive of 0%, based on the total of the powders and the lubricant.

12 Claims, No Drawings

METHOD FOR COMPACTION OF POWDERS FOR POWDER METALLURGY

BACKGROUND OF THE INVENTION

1. Field of the Invention

This invention relates to a method for the compaction of powders for powder metallurgy.

2. Description of the Prior Art

In order to enhance mechanical and magnetic characteristics of compacted products obtained by powder metallurgy, it is effective to increase the density as high as possible. To this end, it is important to obtain a green density, which is as high as possible, at a compacting stage prior to sintering.

Accordingly, there have been adopted methods of promoting compaction of powders for powder metallurgy to which vibrations are applied at a compacting stage (see, for example, Japanese Patent Publication Nos. Hei 3-25278, Sho 41-6549, Sho 54-14781, Sho 54-41525 and the like).

However, these known vibration compactions are a method which has the primary object of promoting rearrangement of powders for powder metallurgy. This method may be effective in the case where compaction is performed at low pressure such as for tile or pottery powders, but is not always a satisfactory one when applied to a field where powders such as iron powders are subjected to plastic deformation at a high compression or compaction pressure and thus, are compacted.

In conventional powder metallurgy, a lubricant is premixed with powders to be compacted to increase the fluidity of the powders so as to reduce the mutual friction between the powders and the friction between the powder and a compacting die or mold. The use of a lubricant is mainly for the purposes of reducing a friction caused on ejection of a green compact from the die and preventing the die from galling.

The formulating amount of a lubricant is generally in the range of from 0.2 to 10 wt % based on the powders to be sintered (see, for example, Japanese Laid-open Patent Application No. Hei 2-156002). In Metal Powder Report, Vol. 42, No. 11, pp. 781-786 (1987), it is stated that a maximum compaction density is obtained when the amount of a lubricant is at 0.5%. In currently employed instances, the amount is, in most cases, in the range of 0.5 to 1.0 wt %.

In this connection, however, if a compacting pressure is increased so as to increase a green density, a lubricant is filled in voids or spaces among starting powders to impede the increase of the density, thus placing the inevitable limitation on high density compaction. Nevertheless, if the amount of a lubricant is reduced, a great friction is brought between the powders and the compaction die, with the attendant problem that high density compaction is disenabled along with a lowering in life of the compaction die.

On the other hand, it is well known that when a lubricant is applied onto the inner wall surfaces of a compaction die, the friction between the powders and the die is reduced. However, because any lubricant is not formulated in starting powders, the powders degrade in fluidity and packing property. Thus, it is difficult to obtain a high density green compact when compacted at high pressure.

Furthermore, U.S. Pat. No. 4,955(5),798 discloses press compaction by heating starting powders at a temperature not higher than the melting point of a lubricant (usually, at approximately 70° C. to 120° C.) in order to increase the density of a green compact. In Japanese Laid-open Patent Application No. Hei 5-271709, it is stated to carry out press compaction by heating to a temperature lower than a temperature at which a lubricant is completely melted (particularly, at temperatures of approximately 370° C. or below). These methods are both based on the finding that if a lubricant melts, the fluidity of powders lowers considerably.

In this connection, however, with an ordinarily employed amount of a lubricant, the lubricant remains within the resultant green compact, and thus, such methods as mentioned above are not ones which fundamentally ensure high density compaction.

In Japanese Laid-open Patent Application No. Hei 9-272901, there is proposed a method of increasing a green density wherein lubricant-free powders are used and a lubricant is applied onto the inner wall surfaces of a compaction die, followed by heating the die to 150 to 400° C. and press compaction. However, any lubricant is not formulated in the starting powders in this method with poor fluidity of the powders. In addition, the powders being compacted are unlikely to cause rearrangement, and a satisfactory high density does not result. Moreover, because the effect of reducing the friction among the powders cannot be obtained in this method, density irregularity is liable to occur inside the resultant green, thereby causing a dimensional variation after sintering.

SUMMARY OF THE INVENTION

It is accordingly an object of the invention to provide a method for the compaction of powders for powder metallurgy which overcomes the problems of the prior art techniques discussed hereinbefore.

It is another object of the invention to provide a method for the compaction of powders for power metallurgy which can overcome the problems on shortage in fluidity of powders at the time of compaction and also on the friction with a die so as to reliably obtain a green compact of high density.

The above objects can be achieved, according to the invention, by a method for the compaction of powders for powder metallurgy, which comprises packing powders for powder metallurgy formulated with a lubricant in a compacting die whose inner wall surfaces are applied with a lubricant, and subjecting the packed powders to warm or hot compaction wherein the lubricant is present in the powders in an amount of 0.2 wt % or below (non-inclusive of 0 wt %) based on the total of the powders and the lubricant.

DETAILED DESCRIPTION OF THE PREFERRED EMBODIMENTS

We have made intensive studies from various angles in order to attain a high density of green compacts, and as a result, found that powders for powder metallurgy formulated with a lubricant are packed in a compaction die applied with a lubricant on the inner wall surfaces thereof and are subsequently subjected to warm or hot compaction wherein when the lubricant formulated in the powders for powder metallurgy is added to in a slightly reduced amount, the above objects can be successfully attained. The invention has been accomplished based on this finding. The preferred embodiments of the invention are described in detail.

The term "powders for powder metallurgy" used herein generically means powders which are used for the manufacture of green compacts of desired forms by subjecting the powders to press compaction to a required contour, followed by sintering, if necessary. Moreover, in the present specification, those powders, which are formulated with lubricants and the like in order to reduce the friction between a die and powder and the mutual friction of the powders, may also be called powders for powder metallurgy.

Specific examples of the powders include metallic powders and ceramic powders. In particular, the method of the invention is very effective when applied to metallic powders which undergo plastic deformation at the time of compaction. Most typical ones include pure iron powders (including those iron powders containing, as impurities, small amounts of C, Mn, Si, P, S, Cr, O, N and the like), alloy powders to which Ni, Mo, Mn, Cr, Si and other elements are purposely added in order to improve strength after sintering (e.g. those powders of the pre-alloy type, diffusion type, hybrid type thereof and the like), or metallic powders undergoing various surface treatments for improving characteristics in magnetic fields, particularly, soft magnetic powders.

When alloy powders are used, care should be paid to the fact that when the amounts of alloy elements are in excess, iron powders become hardened to lower compacting properties, thereby impeding high densification as a powder-metallurgical product.

Various types of alloying elements such as, for example, graphite, Cu, Ni, Mo and the like may be formulated singly or in admixture of two or mores in order to enhance characteristic properties after sintering. Additionally, composite powders may also be used wherein graphite or the like is deposited on individual iron powders by use of a small amount of a binder.

Further, the method of the invention may be effectively applied to soft magnetic materials as set out in Japanese Patent No. 2710152. More particularly, when using soft magnetic powders which individually have, on the surface thereof, an insulating vitreous film containing as its essential elements P, B, Mg and Fe, there can be attained a high green density with an improved balance of magnetic and mechanical characteristics.

It is very important in the practice of the invention how the amount of a lubricant formulated in powders for powder metallurgy is determined. The reason why the amount of a lubricant is determined is described below.

In the warm or hot compaction of such powders as mentioned above, if a lubricant is present in the powders in an amount exceeding 0.2 wt %, not only the fluidity of the powders lowers as a whole, but also it becomes difficult to increase the density of the resultant green compact by means of the lubricant contained inside the green compact. Moreover, in case where the compacting temperature is increased to the melting point or over of the lubricant and the amount of a lubricant is large, it takes a long time before the lubricant oozes out to the surface a green at a compaction pressure, thus making it difficult to satisfactorily perform high density compaction at a compacting speed of a practical level.

On the other hand, where any lubricant is not formulated at all, any lubricant effect is not obtained at the time of compaction. In this condition, not only high densification of a green compact is not attainable, but also density irregularities become great in the inside of the green compact, thereby causing shrinkage of the green subjected to sintering to be locally non-uniform and thus bringing about an undesirable dimensional variation.

For these reasons, the amount of a lubricant is defined in the practice of the invention to be up to 0.2 wt %, non-inclusive of 0 wt %. It is preferred from the standpoint of more improved high densification of a green compact that the lower limit of the amount of a lubricant is at 0.005 wt %, more preferably at 0.01 wt % and most preferably at 0.02 wt %. A preferred upper limit is at 0.1 wt %, more preferably at 0.06 wt %.

The kind of lubricant to be mixed with the powders is not critical, and typical lubricants include metal salts of higher fatty acids such as stearic acid, wax lubricants, and the like. These may be used singly or in combination.

The kind of lubricant to be applied onto inner wall surfaces of a die is not critical as well. Examples include metal salts of higher fatty acids such as stearic acid, wax lubricants, molybdenum disulfide lubricants, BN lubricants, graphite lubricants, and other ordinarily employed lubricants. These may be used singly or in combination of two or more. With regard to either a lubricant added to powders or a lubricant applied to die inner surfaces, an optimum lubricant should preferably be selected depending on the warm or hot compaction temperature.

The manner of applying a lubricant onto the inner surfaces of a compaction die includes a method of deposition in a solid state, a method wherein a lubricant is dissolved or dispersed in a solvent and is applied by a brush or sprayed, a method where a lubricant is thermally melted and applied to, or the like.

As for the compacting temperature, it is important to note that for the compaction, the powders be heated to impart plastic deformability thereto in order to low a deformation resistance. To this end, the powders may be preheated to an appropriate temperature, or may be heated through heat transfer from a compaction die after packing in the die. However, if the temperature of the compaction die is low, the temperature of the powders being compacted or pressed lowers, with a tendency toward the lowering of compacting properties. Hence, it is preferred to keep the die temperature at an appropriate level. In an instance where iron powder, which is typical of powder for powder metallurgy, is used, an appropriate heating temperature for the compaction die is at 80° C. or over. If the temperature is lower than 80° C., the deformation resistance of iron powder is so high that a high density green compact is difficult to obtain.

When the compacting temperature, which is higher than the melting point (Tm) of a lubricant formulated in a starting powder, is adopted, the lubricant is melted upon the compaction and oozes out in the green surface. As a result, the lubricant is naturally removed through the voids among the starting powders, and the oozed lubricant acts to reduce the friction between the compacting die and the powders, thereby contributing to more improved densification of a green compact.

In the prior art techniques set out before, it is accepted as preferred from the standpoint of the enhancement in fluidity of powders that the compacting temperature is below the melting point of a lubricant used. In the practice of the invention, the temperature should not exceed a value of [Tm×3] wherein Tm represents the melting point of a lubricant. This is because if the compacting temperature becomes too high, a lubricant undergoes too great thermal degradation, with the attendant problem that the lubricating effect is lost.

Some types of lubricants may be decomposed or vaporized at temperatures of not higher than [Tm×3] or may be vaporized although not decomposed. In that case, any lubricating effect cannot be expected if lubricants are vaporized. Thus, it is necessary to control the temperature within a range not causing the vaporization.

The method of the invention is also effective without involving any problem when two or more lubricants are formulated. In this case, it is as a matter of fact that some effects can be shown when the compacting temperature is not lower than the melting point of at least one lubricant. However, in order to obtain a better effect, it is preferred to perform the compaction at a temperature higher than the melting points of all lubricants added in the practice of the invention.

The heating method of a compacting die includes, aside from a method of heating with a heater from outside, a method of heating through the Joule heat by application of an electric current, a high frequency heating method, and an infrared heating method without limitation.

Because it takes, more or less, an appreciable time before the powders packed in a compacting die are heated by means of the heated compacting die, it is effective to preheat the powders to a predetermined temperature prior to packing of the powders in the compacting die so as to complete the compaction within a shorter time. In particular, preheating of the powders to a level equal to or higher than the compacting temperature is also effective in shorting the time before the compaction. More particularly, preheating to the temperature, which is not lower than the melting point [Tm] of a formulated lubricant recommended as a preferred compacting temperature, is favorable. However, it should be noted that if the preheating temperature becomes too high, a lubricant undergoes excessive thermal degradation, thus presenting the problem that the lubricating effect is lost. Accordingly, the preheating temperature should not exceed a value of [Tm×3] wherein Tm represents the melting point of a lubricant.

Some types of lubricants may be decomposed or vaporized at temperatures of not higher than [Tm×3] or may be vaporized although not decomposed. In the case, any lubricating effect cannot be expected if lubricants are vaporized. Thus, it is necessary to control the temperature within a range not causing the vaporization. Moreover, when the preheating temperature is too high, the powders may undergo oxidation and care should be paid to the control of an atmosphere.

The compaction pressure is not particularly critical, and a preferred pressure is not lower than 5 tons/cm$^2$when iron powders are used. In the case of the shortage of the compaction pressure, the plastic deformation of iron powders becomes unsatisfactory, making it difficult to increase a green density. It should be noted that an increase in density caused by application of a pressure is almost saturated at 15 tons/cm$^2$, and application of a higher compaction pressure is inconvenient from the economical standpoint or the standpoint of equipment because a higher density cannot be almost expected.

In addition to those set out hereinabove, more compactness or densification can be expected when powders are vibrated at the stage of compaction. For this purpose, any known vibration compaction techniques as set out before may be used, and we have found that when vibration conditions are more precisely controlled, the effect of this technique becomes more remarkable.

More particularly, a better effect is obtained when the amplitude of vibrations given at the time of compaction is appropriately controlled. In order to reduce the mutual friction of the powders by vibrations and densify the powders at the time of compaction thereof, it is necessary to keep the amplitude of the vibration to a certain level or over during the course of the compaction. Where powders, such as iron powders, which undergo plastic deformation, are compacted under high compaction pressure in which vibrations with a satisfactory amplitude are applied to under pressure-free conditions in known vibration compacting methods, the amplitude is attenuated during the compaction and thus, the effect of the vibrations cannot be shown satisfactorily.

Nevertheless, we have confirmed that if the amplitude at the time when a compaction pressure is applied to at a level of 5 tons/cm$^2$ or over is controlled to be at 20% or over, preferably at 50% or over, of an amplitude in a pressure-free condition, there are satisfactorily shown the effects of reducing the mutual friction of the powders and the friction between the powders and the compaction die owing to the vibrations at the time of the high pressure compaction. Thus, the green density can be remarkably increased.

It should be noted that when the amplitude in the course of application of a pressure of 5 tons/cm$^2$ or over is invariably lower than 20% of an amplitude in a pressure-free condition, the effects of reducing the frictions attained by virtue of the vibrations lower significantly.

Where vibrations are given to a compacting die, a green density can be most effectively increased by transmitting vibrations to the powders through upper and lower punches. As a matter of course, the vibrations from an upper punch alone or a lower punch alone, or a combination of vibrations to a die and vibrations from a punch or the punches is also effective. The essential timing when vibrations are applied to is to give vibrations when a compaction pressure is applied to. Whether or not vibrations are applied to at the time of packing of powders or at the time of removal from a die after compaction is optional.

The type of vibration apparatus is not limited to any specific one, and any type of vibration generator may be used provided that it is able to control an amplitude in a manner as set out above.

The fundamental vibration frequency to be imposed on powders is generally selected from a range of 5 Hz to 20 kHz in order to assure the reduction of the mutual friction of powders, and is preferably selected from 5 to 200 Hz. If the fundamental frequency is less than 5 Hz, the mutual friction of powders cannot be reduced satisfactorily. On the contrary, in order to keep such an amplitude exceeding 20 kHz under pressing conditions, an excess energy is required, which is not beneficial for carrying out the compaction on a practical scale. It will be noted that if the amplitudes of frequencies corresponding to integer-fold the exceeding frequencies are synthesized in a vibration generator, any problem is not involved in using such frequencies in practice.

If the amplitude in a pressure-free condition is within a range of 0.002 to 0.20 mm and an amplitude at the time of pressing at 5 tons/cm$^2$ or over is at 20% of the amplitude in a pressure-free condition, a satisfactory amplitude is preferably obtained. If the amplitude is less than 0.002 mm, the amplitude under pressing conditions becomes relatively short, making it difficult to effectively show the effect of the vibrations. In contrast, when the amplitude exceeds 0.20 mm and is thus too great, an excess energy is necessary for keeping the amplitude at the time of pressing, which results in a substantial difficulty in keeping the amplitude under pressing conditions. When the amplitude at the time of pressing at 5 tons/cm$^2$ or over is lower than 20% of the amplitude in the pressure-free condition, the high densification effect at the time of pressing is not attained in a satisfactory manner. Thus, the amplitude under the pressing conditions should be not less than 20% relative to the amplitude in the pressure-free condition. If the amplitude is within a range of 0.2 mm or below in which it is substantially difficult to keep such a great amplitude, the amplitude in the pressing conditions may exceed 100% relative to the amplitude in the pressure-free condition.

The present invention is more particularly described by way of examples, which should not be construed as limiting the invention thereto. Since many variations and alterations may be possible without departing from the spirit of the invention, it is intended that the invention be limited only to the scope of the appended claims.

[Procedure]

Using a V-type mixture, starting powders having formulations indicated in Tables were mixed for 30 minutes. The resultant mixtures were each weighed at about 20 g, followed by packing in a die (with a diameter of 31.5 mm and a depth of 12.5 mm) heated to a preset temperature and compacting under conditions indicated in Tables 1 to 4. In Examples, iron powders "300M" and "4800DFC" (both made by Kobe Steel, Ltd.) were used. In Example D, a vibration generator (vibration disc unit, made by Daiichi K. K.) was used to vibrate the die in the course of the compacting step wherein amplitude A in a pressure-free condition and amplitude B in a pressing condition at 5 tons/cm$^2$ were, respectively, changed at different levels. The densities of the respective greens were measured according to the following method, with the results shown in the tables. It will be noted that the green density was calculated from the volume and weight of each green.

Some tests were effected such that powders were preheated to a compacting temperature, from which it was confirmed that the time of from packing of the powders in a die till compaction could be shortened over the case where no preheating was used.

TABLE 1

| | Compacting Conditions | | | |
|---|---|---|---|---|
| No. | Compacting Temperature (° C.) | Compacting Pressure (tons/cm$^2$) | State of Added Lubricant | Green Density (g/cm$^3$) |
| 1a | 150 | 7 | solid | 7.39 |
| 2a | 150 | 7 | solid | 7.5 |
| 3a | 150 | 7 | solid | 7.48 |
| 4a | 150 | 7 | solid | 7.46 |
| 5a | 150 | 7 | solid | 7.42 |
| 6a | 150 | 7 | solid | 7.36 |
| 7a | 160 | 4 | liquid | 7.21 |
| 8a | 160 | 5 | liquid | 7.44 |
| 9a | 160 | 7 | liquid | 7.51 |
| 10a | 160 | 10 | liquid | 7.60 |
| 11a | 160 | 15 | liquid | 7.65 |
| 12a | 160 | 18 | liquid | 7.65 |

EXAMPLE A

| | Formulating Ratios of Mixed Powders | | | | | | |
|---|---|---|---|---|---|---|---|
| No. | Iron powder | Graphite (wt %) | Other powder for alloy (wt %) | Mixed lubricant 1 | Melting point Tm of lubricant 1 | Amount of lubricant (wt %) | Die lubrication Die lubricant 2 |
| 1a | 300M | 0.75 | Nil | Li stearate | 216 | 0 | Li stearate |
| 2a | 300M | 0.75 | Nil | Li stearate | 216 | 0.005 | Li stearate |
| 3a | 300M | 0.75 | Nil | Li stearate | 216 | 0.05 | Li stearate |
| 4a | 300M | 0.75 | Nil | Li stearate | 216 | 0.1 | Li stearate |
| 5a | 300M | 0.75 | Nil | Li stearate | 216 | 0.2 | Li stearate |
| 6a | 300M | 0.75 | Nil | Li stearate | 216 | 0.25 | Li stearate |
| 7a | 4800 DFC | 0.6 | Nil | Hydrocarbon wax | 150 | 0.1 | Mo disulfide |
| 8a | 4800 DFC | 0.6 | Nil | Hydrocarbon wax | 150 | 0.1 | Mo disulfide |
| 9a | 4800 DFC | 0.6 | Nil | Hydrocarbon wax | 150 | 0.1 | Mo disulfide |

EXAMPLE A-continued

| | Formulating Ratios of Mixed Powders | | | | | | |
|---|---|---|---|---|---|---|---|
| No. | Iron powder | Graphite (wt %) | Other powder for alloy (wt %) | Mixed lubricant 1 | Melting point Tm of lubricant 1 | Amount of lubricant (wt %) | Die lubrication Die lubricant 2 |
| 10a | 4800 DFC | 0.6 | Nil | Hydrocarbon wax | 150 | 0.1 | Mo disulfide |
| 11a | 4800 DFC | 0.6 | Nil | Hydrocarbon wax | 150 | 0.1 | Mo disulfide |
| 12a | 4800 DFC | 0.6 | Nil | Hydrocarbon wax | 150 | 0.1 | Mo disulfide |

Form the above tables, it will be seen that Nos. 1a to 6a are to determine influences on a green density in case where Li stearate was used both as a die lubricant and a lubricant formulated in the powders and the content of the lubricant formulated in the powders was changed. The results of the table reveal that when no lubricant is formulated, the green density is low. When the lubricant is added to in small amounts or up to 0.2 wt %, a high green density is obtained. In particular, the amount ranging from 0.005 to 0.1 wt % results in a high density.

Nos. 7a to 12a are to determine the influences of the compacting pressure on the green density. When the pressure is less than 5 tons/cm$^2$, the green density is not sufficiently high. At about 15 tons/cm$^2$, the increase in the density is saturated. It will be seen that a pressure ranging from 5 to 15 tons/cm$^2$ is preferred.

TABLE 2

| | Compacting Conditions | | | |
|---|---|---|---|---|
| No. | Compacting Temperature (° C.) | Compacting Pressure (tons/cm$^2$) | State of Added Lubricant | Green Density (g/cm$^3$) |
| 1b | 60 | 7 | solid | 7.25 |
| 2b | 80 | 7 | solid | 7.37 |
| 3b | 100 | 7 | solid | 7.37 |

TABLE 2-continued

| | Compacting Conditions | | | |
|---|---|---|---|---|
| No. | Compacting Temperature (° C.) | Compacting Pressure (tons/cm$^2$) | State of Added Lubricant | Green Density (g/cm$^3$) |
| 4b | 130 | 7 | solid | 7.43 |
| 5b | 220 | 7 | liquid | 7.51 |
| 6b | 380 | 7 | liquid | 7.55 |
| 7b | 480 | 7 | gas | 7.55 |
| 8b | 600 | 7 | gas | 7.56 |
| 9b | 60 | 7 | solid | 7.27 |
| 10b | 80 | 7 | solid | 7.37 |
| 11b | 100 | 7 | solid | 7.38 |
| 12b | 130 | 7 | liquid | 7.47 |
| 13b | 220 | 7 | liquid | 7.49 |
| 14b | 380 | 7 | gas | 7.51 |
| 15b | 480 | 7 | gas | 7.50 |
| 16b | 600 | 7 | gas | 7.51 |
| 17b | 150 | 6 | liquid + liquid | 7.43 |
| 18b | 150 | 6 | liquid + solid | 7.39 |
| 19b | 150 | 6 | solid + solid | 7.36 |

EXAMPLE B

| | Formulating Ratios of Mixed Powders | | | | | | |
|---|---|---|---|---|---|---|---|
| No. | Iron powder | Graphite (wt %) | Other powder for alloy (wt %) | Mixed lubricant 1 | Melting point Tm of lubricant 1 | Amount of lubricant (wt %) | Die lubrication Die lubricant 2 |
| 1b | 300M | 0.75 | 1.5% Ni | Li stearate | 216 | 0.05 | Li stearate |
| 2b | 300M | 0.75 | 1.5% Ni | Li stearate | 216 | 0.05 | Li stearate |
| 3b | 300M | 0.75 | 1.5% Ni | Li stearate | 216 | 0.05 | Li stearate |
| 4b | 300M | 0.75 | 1.5% Ni | Li stearate | 216 | 0.05 | Li stearate |
| 5b | 300M | 0.75 | 1.5% Ni | Li stearate | 216 | 0.05 | Li stearate |
| 6b | 300M | 0.75 | 1.5% Ni | Li stearate | 216 | 0.05 | Li stearate |
| 7b | 300M | 0.75 | 1.5% Ni | Li stearate | 216 | 0.05 | Li stearate |
| 8b | 300M | 0.75 | 1.5% Ni | Li stearate | 216 | 0.05 | Li stearate |
| 9b | 4800 DFC | 0.75 | 1.5% Cu | Zn stearate | 126 | 0.05 | graphite |
| 10b | 4800 DFC | 0.75 | 1.5% Cu | Zn stearate | 126 | 0.05 | graphite |
| 11b | 4800 DFC | 0.75 | 1.5% Cu | Zn stearate | 126 | 0.05 | graphite |
| 12b | 4800 DFC | 0.75 | 1.5% Cu | Zn stearate | 126 | 0.05 | graphite |
| 13b | 4800 DFC | 0.75 | 1.5% Cu | Zn stearate | 126 | 0.05 | graphite |
| 14b | 4800 DFC | 0.75 | 1.5% Cu | Zn stearate | 126 | 0.05 | graphite |
| 15b | 4800 DFC | 0.75 | 1.5% Cu | Zn stearate | 126 | 0.05 | graphite |
| 16b | 4800 DFC | 0.75 | 1.5% Cu | Zn stearate | 126 | 0.05 | graphite |
| 17b | 300M | 0.75 | 1.5% Cu | Zn stearate + | 126° C. | 0.025 | Li stearate |

EXAMPLE B-continued

| | Formulating Ratios of Mixed Powders | | | | | | |
|---|---|---|---|---|---|---|---|
| No. | Iron powder | Graphite (wt %) | Other powder for alloy (wt %) | Mixed lubricant 1 | Melting point Tm of lubricant 1 | Amount of lubricant (wt %) | Die lubrication Die lubricant 2 |
| | | | | hydrocarbon wax | 143° C. | 0.025 | |
| 18b | 300M | 0.75 | 1.5% Cu | Zn stearate + hydrocarbon wax | 126° C. 158° C. | 0.025 0.025 | Li stearate |
| 19b | 300M | 0.75 | 1.5% Cu | Li stearate + hydrocarbon wax | 216° C. 158° C. | 0.025 0.025 | Li stearate |

From the above tables, it will be seen that Nos. 1b to 8b are to determine the influences on the green density in the case where lithium stearate was used both as a die lubricant and a lubricant formulated in the powders and the compacting temperature is changed in a wide range. With Nos. 5b and 6b where the compacting temperature is set at a level higher than the melting point of the lubricant, the resultant green density is higher than those of Nos. 1b to 4b wherein the compacting temperature is lower than the melting point of the lubricant. In Nos. 7b and 8b, the formulated lubricant is vaporized, so that the effect of increasing the temperature is not shown, thus being poor in economy.

Nos. 9b to 16b are to determine the influences on a green density in the case where a graphite-based lubricant was used as a die lubricant and zinc stearate was as a lubricant formulated in the powders, and the compacting temperature is changed in a wide range. With Nos. 12b to 16b wherein the compacting temperature is higher than the melting points of the lubricants, green densities obtained are higher than those of Nos. 9b to 11b where the compacting temperature is lower than the melting points of the lubricants. In this connection, however, with Nos. 15b and 16b, the formulated lubricants are vaporized, so that the density is not so high although the temperature is increased. Thus, these are not good. Nos. 17 to 19 make use of two types of lubricants being mixed. Since the total amount of the lubricants is within a range of the invention, a high green density is obtained. In particular, a green density of No. 18b wherein the compacting temperature is higher than that of one of the mixed lubricants is high. Moreover, the highest density is obtained in No. 17b wherein the compacting temperature is higher than the melting points of both lubricants.

TABLE 3

| | Compacting Conditions | | | |
|---|---|---|---|---|
| No. | Compacting Temperature (° C.) | Compacting Pressure (tons/cm$^2$) | State of Added Lubricant | Green Density (g/cm$^3$) |
| 1c | 25 | 7 | solid | 7.18 |
| 2c | 100 | 7 | solid | 7.24 |
| 3c | 150 | 7 | solid | 7.24 |
| 4c | 200 | 7 | solid | 7.23 |
| 5c | 250 | 7 | liquid | 7.26 |
| 6c | 25 | 7 | solid | 7.08 |
| 7c | 150 | 7 | liquid | 7.24 |
| 8c | 150 | 7 | liquid | 7.24 |
| 9c | 150 | 7 | liquid | 7.25 |
| 10c | 150 | 7 | liquid | 7.20 |
| 11c | 150 | 7 | liquid | 7.14 |
| 12c | 150 | 7 | liquid | 7.07 |

EXAMPLE C

| | Formulating Ratios of Mixed Powders | | | | | | |
|---|---|---|---|---|---|---|---|
| No. | Iron powder | Graphite (wt %) | Other powder for alloy (wt %) | Mixed lubricant 1 | Melting point Tm of lubricant 1 | Amount of lubricant (wt %) | Die lubrication Die lubricant 2 |
| 1c | insulated iron powder A | Nil | Nil | Li stearate | 216 | 0.1 | Mo disulfide |
| 2c | insulated iron powder A | Nil | Nil | Li stearate | 216 | 0.1 | Mo disulfide |
| 3c | insulated iron powder A | Nil | Nil | Li stearate | 216 | 0.1 | Mo disulfide |

EXAMPLE C-continued

| | Formulating Ratios of Mixed Powders | | | | | | |
|---|---|---|---|---|---|---|---|
| No. | Iron powder | Graphite (wt %) | Other powder for alloy (wt %) | Mixed lubricant 1 | Melting point Tm of lubricant 1 | Amount of lubricant (wt %) | Die lubrication Die lubricant 2 |
| 4c | insulated iron powder A | Nil | Nil | Li stearate | 216 | 0.1 | Mo disulfide |
| 5c | insulated iron powder A | Nil | Nil | Li stearate | 216 | 0.1 | Mo disulfide |
| 6c | insulated iron powder A | Nil | Nil | Li stearate | 216 | 0.75 | Nil |
| 7c | insulated iron powder A | Nil | Nil | Zn stearate | 126 | 0.005 | Mo disulfide |
| 8c | insulated iron powder A | Nil | Nil | Zu stearate | 126 | 0.01 | Mo disulfide |
| 9c | insulated iron powder A | Nil | Nil | Zn stearate | 126 | 0.1 | Mo disulfide |
| 10c | insulated iron powder A | Nil | Nil | Zn stearate | 126 | 0.2 | Mo disulfide |
| 11c | insulated iron powder A | Nil | Nil | Zn stearate | 126 | 0.4 | Mo disulfide |
| 12c | insulated iron powder A | Nil | Nil | Zn stearate | 126 | 0.75 | Nil |

Insulated iron powder A was prepared by applying an aqueous solution containing phosphoric acid, boric acid and magnesium oxide onto the surfaces of iron powders and dried to form an insulating vitreous film on the surfaces of individual iron powders. This iron powder was used and compacted into 12 mm×30 mm×6 mm pieces under conditions indicated in Table 3 above.

Nos. 1c to 5c are all within the scope of the invention and high densities are obtained. In particular, in No. 5c, compaction is effected at a temperature higher than the melting point of the lubricant, so that a very high density is obtained. No. 6c is directed to a prior art technique, and the resultant density is very low. In Nos. 7c to 12c, the amount of the lubricant is widely changed. Within the range up to 0.2 wt % defined in the present invention, good results are obtained. In Nos. 11c, 12c, the amount is too large, both a density and a bending strength are poor. In particular, No. 12c makes use of such a large amount of the lubricant as in prior art, so that the density is very low.

TABLE 4

| | Compacting conditions | | | | | | |
|---|---|---|---|---|---|---|---|
| No. | Compacting Temp. (° C.) | Compacting Pressure (tons/cm$^3$) | Frequency (Hz) | Amplitude A in pressure-free condition (mm) | Amplitude B under pressing at 5 tons/cm$^2$ (mm) | Attenuation rate (B/A) × 100 | Green Density (g/cm$^3$) |
| 1d | 150 | 7 | 50 | 0.05 | 0.04 | 80.0 | 7.58 |
| 2d | 150 | 7 | 50 | 0.05 | 0.025 | 50.0 | 7.58 |
| 3d | 150 | 7 | 50 | 0.05 | 0.024 | 48.0 | 7.54 |
| 4d | 150 | 7 | 50 | 0.05 | 0.019 | 38.0 | 7.53 |
| 5d | 150 | 7 | 50 | 0.05 | 0.01 | 20.0 | 7.52 |
| 6d | 150 | 7 | 50 | 0.05 | 0.008 | 16.0 | 7.49 |
| 7d | 150 | 7 | 50 | 0.05 | 0.007 | 14.0 | 7.48 |
| 8d | 160 | 7 | 50 | 0.001 | 0.0003 | 30.0 | 7.48 |
| 9d | 160 | 7 | 50 | 0.002 | 0.001 | 50.0 | 7.52 |
| 10d | 160 | 7 | 50 | 0.01 | 0.004 | 40.0 | 7.52 |
| 11d | 160 | 7 | 50 | 0.05 | 0.017 | 34.0 | 7.54 |
| 12d | 160 | 7 | 50 | 0.1 | 0.0205 | 20.5 | 7.57 |
| 13d | 160 | 7 | 50 | 0.2 | 0.044 | 22.0 | 7.55 |
| 14d | 160 | 7 | 50 | 0.25 | 0.032 | 12.8 | 7.52 |
| 15d | 150 | 4 | 50 | 0.051 | 0.026 | 51.0 | 7.37 |
| 16d | 150 | 5 | 50 | 0.05 | 0.023 | 46.0 | 7.41 |
| 17d | 150 | 7 | 50 | 0.05 | 0.022 | 44.0 | 7.53 |

TABLE 4-continued

| | Compacting conditions | | | | | | |
|---|---|---|---|---|---|---|---|
| No. | Compacting Temp. (° C.) | Compacting Pressure (tons/cm$^3$) | Frequency (Hz) | Amplitude A in pressure-free condition (mm) | Amplitude B under pressing at 5 tons/cm$^2$ (mm) | Attenuation rate (B/A) × 100 | Green Density (g/cm$^3$) |
| 18d | 150 | 10 | 50 | 0.052 | 0.019 | 36.5 | 7.64 |
| 19d | 150 | 15 | 50 | 0.05 | 0.01 | 20.0 | 7.69 |
| 20d | 150 | 18 | 50 | 0.05 | 0.008 | 16.0 | 7.70 |
| 21d | 150 | 7 | 15 | 0.05 | 0.038 | 76.0 | 7.52 |
| 22d | 150 | 7 | 20 | 0.05 | 0.011 | 22.0 | 7.56 |
| 23d | 150 | 7 | 100 | 0.05 | 0.02 | 40.0 | 7.58 |
| 24d | 150 | 7 | 200 | 0.05 | 0.021 | 42.0 | 7.57 |
| 25d | 150 | 7 | 15k | 0.05 | 0.012 | 24.0 | 7.53 |
| 26d | 150 | 7 | 200k | 0.05 | 0.01 | 20.0 | 7.53 |
| 27d | 150 | 7 | 250k | 0.05 | 0.005 | 10.0 | 7.48 |

EXAMPLE D

| | Formulating Ratios of Mixed Powders | | | | | | |
|---|---|---|---|---|---|---|---|
| No. | Iron powder | Graphite (wt %) | Other powder for alloy (wt %) | Mixed lubricant 1 | Melting point Tm of lubricant 1 | Amount of lubricant (wt %) | Die lubrication Die lubricant 2 |
| 1d | 300M | 0.75 | 1.0 Cu, 1.5% Ni | Zn stearate | 126 | 0.1 | Li stearate |
| 2d | 300M | 0.75 | 1.0 Cu, 1.5% Ni | Zn stearate | 126 | 0.1 | Li stearate |
| 3d | 300M | 0.75 | 1.0 Cu, 1.5% Ni | Zn stearate | 126 | 0.1 | Li stearate |
| 4d | 300M | 0.75 | 1.0 Cu, 1.5% Ni | Zn stearate | 126 | 0.1 | Li stearate |
| 5d | 300M | 0.75 | 1.0 Cu, 1.5% Ni | Zn stearate | 126 | 0.1 | Li stearate |
| 6d | 300M | 0.75 | 1.0 Cu, 1.5% Ni | Zn stearate | 126 | 0.1 | Li stearate |
| 7d | 300M | 0.75 | 1.0 Cu, 1.5% Ni | Zn stearate | 126 | 0.1 | Li stearate |
| 8d | 300M | 0.75 | 1.5% Cu | Hydrocarbon wax | 145 | 0.1 | Li stearate |
| 9d | 300M | 0.75 | 1.5% Cu | Hydrocarbon wax | 145 | 0.1 | Li stearate |
| 10d | 300M | 0.75 | 1.5% Cu | Hydrocarbon wax | 145 | 0.1 | Li stearate |
| 11d | 300M | 0.75 | 1.5% Cu | Hydrocarbon wax | 145 | 0.1 | Li stearate |
| 12d | 300M | 0.75 | 1.5% Cu | Hydrocarbon wax | 145 | 0.1 | Li stearate |
| 13d | 300M | 0.75 | 1.5% Cu | Hydrocarbon wax | 145 | 0.1 | Li stearate |
| 14d | 300M | 0.75 | 1.5% Cu | Hydrocarbon wax | 145 | 0.1 | Li stearate |
| 15d | 4800 DFC | 0.6 | Nil | Zn stearate | 126 | 0.1 | Li stearate |
| 16d | 4800 DFC | 0.6 | Nil | Zn stearate | 126 | 0.1 | Li stearate |
| 17d | 4800 DFC | 0.6 | Nil | Zn stearate | 126 | 0.1 | Li stearate |
| 18d | 4800 DFC | 0.6 | Nil | Zn stearate | 126 | 0.1 | Li stearate |
| 19d | 4800 DFC | 0.6 | Nil | Zn stearate | 126 | 0.1 | Li stearate |
| 20d | 4800 DFC | 0.6 | Nil | Zn stearate | 126 | 0.1 | Li stearate |
| 21d | 300M | 0.75 | 1.5% Ni | Li stearate | 216 | 0.05 | Mo disulfide |
| 22d | 300M | 0.75 | 1.5% Ni | Li stearate | 216 | 0.05 | Mo disulfide |
| 23d | 300M | 0.75 | 1.5% Ni | Li stearate | 216 | 0.05 | Mo disulfide |
| 24d | 300M | 0.75 | 1.5% Ni | Li stearate | 216 | 0.05 | Mo disulfide |
| 25d | 300M | 0.75 | 1.5% Ni | Li stearate | 216 | 0.05 | Mo disulfide |
| 26d | 300M | 0.75 | 1.5% Ni | Li stearate | 216 | 0.05 | Mo disulfide |
| 27d | 300M | 0.75 | 1.5% Ni | Li stearate | 216 | 0.05 | Mo disulfide |

From the results of the above tables, it will be seen that No. 1d to 7d are ones wherein the attenuation rate of vibrations (i.e. a ratio of the amplitude B at the time of pressing at 5 tons/cm$^2$ and the amplitude A in a pressure-free condition) at the time of press compaction is changed. When the attenuation rate is within the range defined in the invention (Nos. 1d to 5d), the green density is higher than those of Nos. 6d and 7d wherein the amplitude attenuation rate at the time of press compaction is less than 20%.

With Nos. 8d to 14d where the amplitude of vibrations is changed, when the amplitude is within a range defined in the invention, higher green densities are obtained than those of Nos. 8d, 14d where the amplitude is out of the range defined in the invention.

In Nos. 15d to 20d, a compacting pressure is changed, under which when the compacting pressure is less than 5 tons/cm$^2$ (No. 15d), the green density is low. A higher compacting pressure leads to a higher green density, but the increasing rate is saturated at 15 tons/cm2. A higher pressure does not permit a significant increase of the green density, thus being poor in economy.

In Nos. 21d to 27d, the frequency of vibrations is changed. With Nos. 21d to 26 d wherein the frequency range is within a range defined in the invention, high green densities are obtained. In particular, with Nos. 22d to 24d wherein the frequency is within a preferred range (20 to 200 Hz), very high green densities are obtained.

What is claimed is:

1. A method for the compaction of powders for powder metallurgy, the method comprising packing powders for powder metallurgy formulated with a lubricant in a compacting die whose inner wall surfaces are applied with a lubricant, and subjecting the packed powders to compaction to form a green compact, wherein the green compact consists essentially of the powders, and the lubricant in an amount greater than 0 wt % and less than or equal to 0.06 wt % based on a total of the powders and the lubricant, wherein the compaction is carried out at a temperature which is higher than the melting point of the lubricant formulated in said powders.

2. A method according to claim 1, wherein said powders for powder metallurgy consist of soft magnetic powders individually having, on the surfaces thereof, an insulating vitreous film comprising essential elements of P, B, Mg, and Fe.

3. A method according claim 1, wherein said temperature is at 3×[Tm]° C. or below and is lower than a decomposition and vaporization temperature of said lubricant.

4. A method according claim 1, wherein said temperature is at 3×[Tm]° C. or below and is lower than a decomposition and vaporization temperature of said lubricant.

5. A method according to claim 1, wherein the powders for powder metallurgy wherein lubricant is formulated is preheated to a temperature higher than the melting point [Tm] of said lubricant formulated in said powders prior to packing in said compacting die.

6. A method according to claim 1, wherein the powders for powder metallurgy wherein lubricant is formulated is preheated to a temperature higher than the melting point [Tm] of said lubricant formulated in said powders prior to packing in said compacting die.

7. A method according to claim 3, wherein the powders for powder metallurgy wherein lubricant is formulated is preheated to a temperature higher than the melting point [Tm] of said lubricant formulated in said powders prior to packing in said compacting die.

8. A method according to claim 4, wherein the powders for powder metallurgy wherein lubricant is formulated is preheated to a temperature higher than the melting point [Tm] of said lubricant formulated in said powders prior to packing in said compacting die.

9. A method according to claim 1, wherein the compaction is carried out at a maximum compacting pressure set within a range of from 5 to 15 tons/cm$^2$.

10. A method according to claim 1, wherein the compaction is carried out at a maximum compacting pressure set at 5 tons/cm$^2$ or over, vibrations are applied to said compacting die, an amplitude in a pressure-free condition is set at 0.002 to 0.20 mm for half amplitude (0 to peak), and part or all of a time when the compacting pressure is 5 tons/cm$^2$ or over is not less than 20% of the amplitude in a pressure-free condition.

11. A method according to claim 10, wherein said vibrations has a frequency of 5 Hz to 20 kHz.

12. A method for the compaction of powders for powder metallurgy, the method comprising packing powders for powder metallurgy formulated with a lubricant in a compacting die whose inner wall surfaces are applied with a lubricant, and subjecting the packed powders to compaction to form a green compact, wherein the green compact consists essentially of the powders, and the lubricant in an amount greater than 0 wt % and less than or equal to 0.2 wt % based on a total of the powders and the lubricant, wherein the compaction is carried out at a temperature which is higher than the melting point of the lubricant formulated in said powders.

* * * * *

UNITED STATES PATENT AND TRADEMARK OFFICE

CERTIFICATE OF CORRECTION

PATENT NO. : 6,344,169 B2
DATED : February 5, 2002
INVENTOR(S) : Tsuchida et al.

It is certified that error appears in the above-identified patent and that said Letters Patent is hereby corrected as shown below:

Title page,

Item [45], CPA should read as follows:

-- [45] **Date of Patent: *Feb. 5, 2002** --

-- [*] Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days. --

Item [30], the Foreign Application Priority Data should read as follows:

-- [30] Foreign Application Priority Data

Nov. 5, 1998 (JP) ..... 10-315030
Nov. 5, 1998 (JP) ..... 10-315031
Nov. 5, 1998 (JP) ..... 10-315032
Oct. 5, 1999 (JP) ..... 11-284827 --

Signed and Sealed this

Thirtieth Day of July, 2002

*Attest:*

*Attesting Officer*

JAMES E. ROGAN
*Director of the United States Patent and Trademark Office*